United States Patent [19]

Dale

[11] 4,073,460

[45] Feb. 14, 1978

[54] STAND FOR CALCULATOR

[75] Inventor: Richard Dale, New York, N.Y.

[73] Assignee: Appollon Designs, Inc., New York, N.Y.

[21] Appl. No.: 707,267

[22] Filed: July 21, 1976

[51] Int. Cl.[2] ..... A47B 19/00

[52] U.S. Cl. ..... 248/441 R; 248/13; 248/174

[58] Field of Search ..... 211/50; 248/13, 19, 248/441, 459, 117.2, 174, 175, 300, 346

[56] References Cited

U.S. PATENT DOCUMENTS

| | | | |
|---|---|---|---|
| 1,848,694 | 3/1932 | Bucklin | 211/50 |
| 1,958,084 | 5/1934 | Frey | 211/50 |
| 2,230,511 | 2/1941 | Luttrup | 248/19 |
| 2,656,098 | 10/1953 | Hutton | 248/19 X |
| 3,086,658 | 4/1963 | Palmer | 248/441 X |
| 3,809,352 | 5/1974 | Mathias | 248/441 A UX |
| 3,885,762 | 5/1975 | Sebastiani | 248/13 |
| 3,945,598 | 3/1976 | Bell | 248/441 D |
| 3,984,074 | 10/1976 | Forman et al. | 248/463 X |

FOREIGN PATENT DOCUMENTS

| | | | |
|---|---|---|---|
| 11,109 of | 1897 | United Kingdom | 248/459 |
| 1,383,609 | 2/1975 | United Kingdom | 248/441 B |
| 263,983 | 1/1927 | United Kingdom | 248/174 |

*Primary Examiner*—Lawrence J. Staab
*Attorney, Agent, or Firm*—Allison C. Collard

[57] ABSTRACT

A stand for a conventional rectilinearly shaped compact high-speed manual digital calculator is provided which is removably mountable on a table-top, desk-top or like planar support and skid resistant thereon. The stand includes a substantially rectilinear web having a first elevated end and a second descendent end contiguous to the planar support. Proximately underlying the second end of the web is a rail flange having upper and lower oblique surfaces corresponding to the angle of elevation of the web and providing a level mount therefor. Issuing generally upwardly from the second end of the web is a lip flange which provides a fixed support for a calculator overlying the web. Cooperating means are mounted in the surfaces of the stand that engage the support which render the stand substantially skid resistant thereon.

1 Claim, 4 Drawing Figures

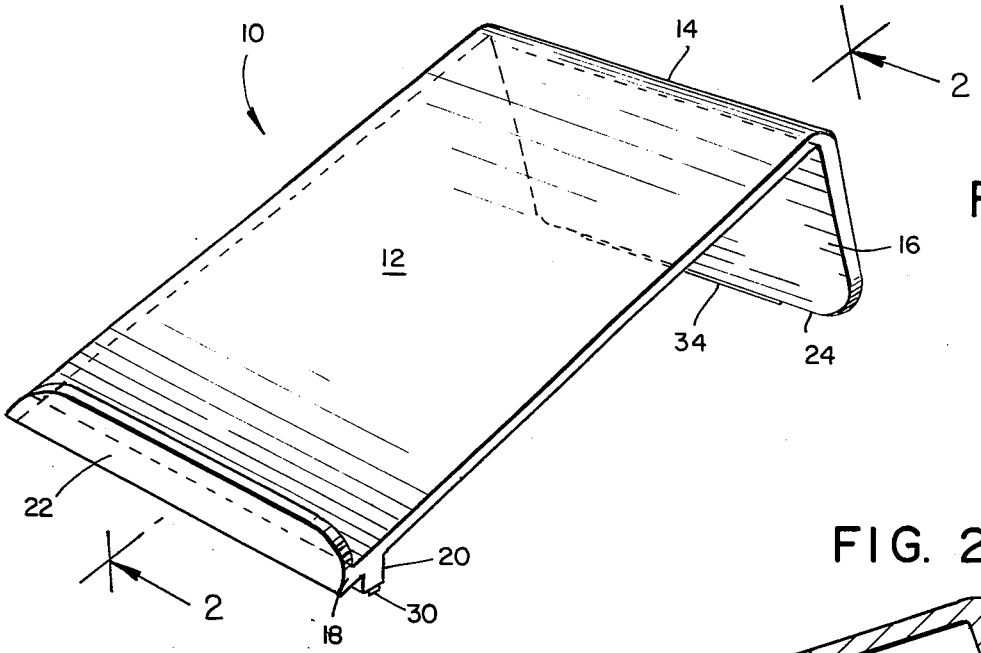
FIG. 1
FIG. 2
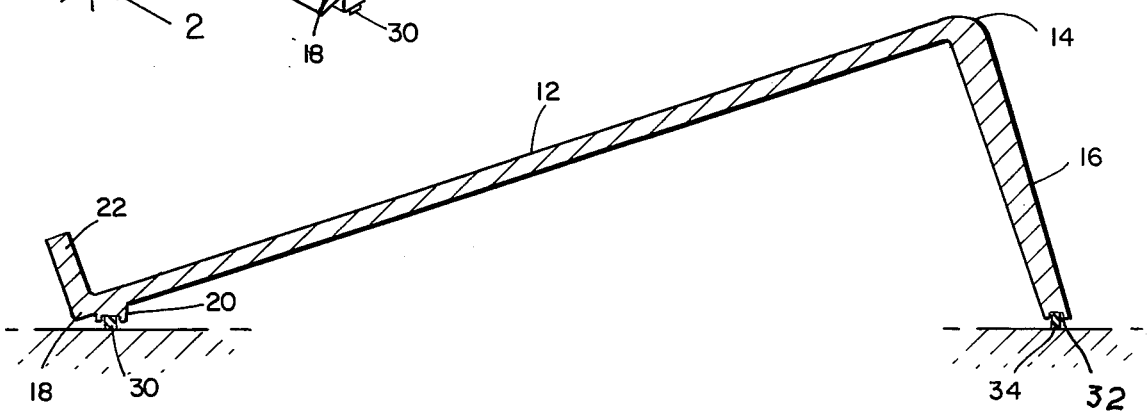
FIG. 3
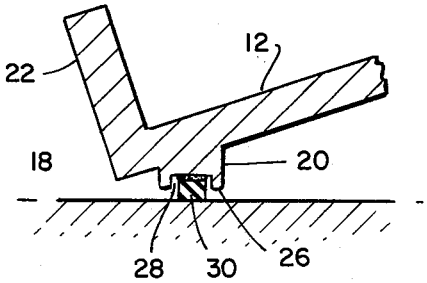
FIG. 4
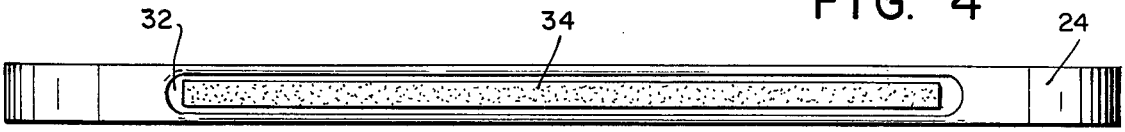

STAND FOR CALCULATOR

BACKGROUND OF THE INVENTION

The present invention relates generally to a novel construction for a stand, and more particularly the instant invention relates to a novel construction for a stand for a compact digital calculator.

Millions of compact high-speed manual digital calculators of the type that perform usual arithmetic functions are in use today in this country. The calculator is usually hand-held, while the key board is manually punched. Accordingly, the instant invention provides a convenient releasable support for the conventional calculator.

SUMMARY OF THE INVENTION

Generally speaking, in accordance with the invention, a supporting stand for a conventional rectilinearly shaped compact high-speed manual digital calculator is provided which is removably mountable on a table-top, desk-top or like planar support and skid resistant thereon. The stand includes a substantially rectilinear web having a first elevated end and a second descendent end contiguous to the planar support. Proximately underlying the second end of the web is a rail flange having upper and lower oblique surfaces corresponding to the angle of elevation of the web and providing a level mount therefor. Issuing generally upwardly from the second end of the web is a lip flange which provides a fixed support for a calculator overlying the web. Cooperating means are mounted in the surfaces of the stand that engage the support which render the stand substantially skid resistant thereon.

Accordingly, it is an object of the invention to provide a stand having a novel construction.

Another object of the invention is to provide a novel stand for a manually operated calculator.

A further object of the invention is to provide a light weight movable stand for a manually operated calculator which is skid resistant on a support surface.

Still another object of the invention is to provide an inexpensive injection molded stand for a calculator.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWING

For a fuller understanding of the invention, reference is had to the following description taken in connection with the accompanying drawing, in which:

FIG. 1 is a perspective view of a calculator stand constructed in accordance with the instant invention;

FIG. 2 is a sectional view taken along line 2—2 of FIG. 1;

FIG. 3 is a fragmentary detail view of the front end of the stand seen in FIG. 2; and FIG. 4 is a detailed bottom view of the rear support for the stand.

DETAILED DESCRIPTION OF THE INVENTION

Referring now to the Drawing, the calculator stand generally numbered 10 includes a substantially rectilinear inclined web 12 having a first end 14 elevated on a butt flange 16, and a second descendent end 18 supported on a rail flange 20. Issuing generally upwardly from the second end 18 of web 12 is a lip flange 22 which provides a fixed support for a calculator overlying the web 12.

Rail flange 20 is beveled to correspond generally with the angle of inclination of web 12. While the angle of inclination of web 12 is not critical, it must be less than 90° to provided a bed rest for the calculator, and an angle of about 45° and less is generally preferred.

Butt flange 16 stands oblique relative to web 12 and the planar support surface, not shown, on which the stand 10 is mounted to maximize the stability of the stance of the stand 10 on the support surface. Therefore, the bottom surface 24 of butt flange 16 is beveled to correspond with rail flange 20 and level the stance of the stand 10 on the support.

The bottom or support engaging surface 26 of rail flange 20 is provided with a longitudinally elongated recess 28 and a felt strip 30 is mounted therein. A clearance is provided between the sidewall of recess 28 and felt strip 30 and felt strip 30 extends outwardly past the mouth of recess 28 to abut the support surface. A corresponding recess 32 is provided in surface 24 of butt flange 16 and a felt strip 34 is mounted therein in the manner hereinbefore described.

The corresponding recess and felt strip arrangements in rail flange 20 and butt flange 16, respectively, provide a friction brake which prevents the stand 10 from sliding even over smooth, highly polished surfaces. This feature is deemed to be a significant aspect of the invention.

In practice, the stand 10 is mounted on a substantially planar support surface with felt strips 30 and 34, respectively abutting the surface. The calculator is overlaid on web 12 in operative position and lip flange 22 provides a bearing support therefor.

The stand 10 may be fabricated from a large variety of conventional materials. However, as a matter of economy, convenience, and length of useful life plastic is a preferred material. The plastic employed may be translucent or opaque and the stand may for instance be injection molded therefrom.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A supporting stand for a calculator which is removably mountable on a planar support comprising, a substantially rectilinear web having a first elevated end, and a second descendent end substantially contiguous to said planar support; a lip flange connected to said web, said lip flange issuing upwardly from said second descendent end of said web substantially normally thereto, said lip flange providing a bearing support for a calculator overlying said web; a substantially rectilinear butt flange connected to said web, said butt flange issuing downwardly substantially from said first elevated end of said web, and elevating said web at a predetermined angle of inclination relative to a horizontal plane medianly through said stand of about 45° or less a longitudinally extending rail flange connected to said web, said rail flange underlying substantially said second end of said web, and having respective upper and lower oblique surfaces, said upper oblique surface thereof being fixedly connected to said web, said upper and lower oblique surfaces defining an angle corresponding to the angle of inclination of said web and providing a level mount therefor, said butt flange and said rail flange having respective beveled planar support engaging surfaces, and including cooperating means mounted, respectively, in said beveled planar support engaging surfaces of said butt flange and said rail flange, for rendering said stand substantially skid resistant on said planar support, said means comprising a corresponding longitudinally elongated recess in each of said beveled planar support engaging surfaces provided in said butt flange and said rail flange, and a felt strip mounted in each of said recesses spaced from the side walls of said recesses to provide a clearance therebetween, each of said felt strips extending past the mouth of its respective recess to abut a planar support surface on which said stand is mounted.

* * * * *